US007694689B2

(12) United States Patent
Woo

(10) Patent No.: US 7,694,689 B2
(45) Date of Patent: Apr. 13, 2010

(54) DISH WASHER AND SUMP MOUNTING STRUCTURE THEREOF

(75) Inventor: Sang Woo Woo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1041 days.

(21) Appl. No.: 11/295,674

(22) Filed: Dec. 7, 2005

(65) Prior Publication Data

US 2006/0118145 A1 Jun. 8, 2006

(30) Foreign Application Priority Data

Dec. 7, 2004 (KR) ..... 10-2004-0102554

(51) Int. Cl.
*B08B 3/04* (2006.01)

(52) U.S. Cl. ..... 134/104.4; 415/213.1; 134/57 D; 134/104.2

(58) Field of Classification Search ..... 134/56 D, 134/57 D, 104.4
See application file for complete search history.

(56) References Cited

U.S. PATENT DOCUMENTS 4,060,346 A * 11/1977 Meyers ..... 417/360
4,271,861 A * 6/1981 Crawford ..... 137/387

* cited by examiner

*Primary Examiner*—Michael Barr
*Assistant Examiner*—Jason Y Ko
(74) *Attorney, Agent, or Firm*—McKenna Long & Aldridge LLP

(57) ABSTRACT

There is provided a sump mounting structure of a dishwasher having a tub and a sump assembly mounted on a bottom of the tub. The sump mounting structure includes at least one mounting hook unit extending from an outer circumference of the sump assembly and a mounting ring unit associated with the mounting hook unit to prevent the mounting hook unit from shaking.

20 Claims, 8 Drawing Sheets

DISH WASHER AND SUMP MOUNTING STRUCTURE THEREOF

This application claims priority to Korean Application 10-2004-0102554 filed on Dec. 7, 2004, which is incorporated by reference, as if fully set forth herein.

BACKGROUND OF THE INVENTION

1. Field of the Invention

The present invention relates to a dishwasher, and more particularly, to a sump mounting structure that allows a sump assembly to be easily dismounted from a bottom of tube in a state where a dishwasher is fixed, thereby improving maintenance service efficiency.

2. Description of the Related Art

Generally, a dishwasher is a machine that washes and dries dishes loaded on upper and lower racks by spraying washing water pumped by the washing pump toward the upper and lower racks through spraying nozzles. The dishwasher includes a tub defining an outer appearance of the dishwasher, at least one rack disposed in the tub to load dishes, at least one spraying nozzle for spraying washing water to surfaces of the dishes, and a sump assembly mounted on a floor of the tub to reserve the washing water. Foreign objects such as food wastes adhered to the dishes are removed from the dishes by pressure applied by washing water sprayed from a spraying nozzle. The food wastes removed from the dishes are collected on a floor of the tub.

The sump assembly supplying the washing water into the tube of the dishwasher is generally mounted on a bottom of the tub.

In the dishwasher of the related art, a special holder is used to assemble the sump assembly to the tub. In this case, the sump assembly is fixed to the tub by screws.

Therefore, when it is intended to separate the sump assembly from the tub to repair or change a damaged or broken component disposed in the sump assembly, the dishwasher must be turned upside down to release the screws. This is time-consuming and there is a lot of labor required.

SUMMARY OF THE INVENTION

Accordingly, the present invention is directed to a sump mounting structure of a dishwasher that substantially obviates one or more problems due to limitations and disadvantages of the related art.

An object of the present invention is to provide a sump mounting structure of a dishwasher that can improve maintenance service efficiency by allowing a sump assembly to be easily mounted on or dismounted from a bottom of a tub.

To achieve these objects and other advantages and in accordance with the purpose of the invention, as embodied and broadly described herein, there is provided a sump mounting structure of a dishwasher having a tub and a sump assembly mounted on a bottom of the tub, the sump mounting structure comprising: at least one mounting hook unit extending from an outer circumference of the sump assembly; and a mounting ring unit associated with the mounting hook unit to prevent the mounting hook unit from shaking.

In another aspect of the present invention, there is provided a sump mounting structure of a dishwasher having a tub, a sump case mounted on a bottom of the tub to reserve washing water, and a sump cover covering the sump case, the sump mounting structure comprising: at least one mounting hook unit extending from an outer circumference of the sump case, the mounting hook unit having a hook portion protruded from a front surface; and a mounting ring unit removably fitted on the mounting hook unit to prevent the mounting hook unit from shaking.

In still another aspect of the preset invention, there is provided a sump mounting structure of a dishwasher having a tub and a washing water reserving unit mounted on a bottom of the tub, the washing water reserving unit having a sump case for reserving washing water and a sump cover for covering the sump case, the sump mounting structure comprising: a mounting hook unit extending from an outer circumference of the sump case to allow the sump case to be fixed on the bottom of the tub; and a mounting ring unit fitted to the mounting hook unit to prevent the mounting hook unit from shaking.

According to the sump mounting structure of the present invention, since the sump assembly can be easily mounted on or dismounted from the tub in a state where the dishwasher is fixed, the maintenance service can be effectively performed.

Particularly, even when the dishwasher is a built-in product that cannot be displaced once it is installed in a location, the sump assembly can be easily dismounted to save the time and labor for the maintenance service.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
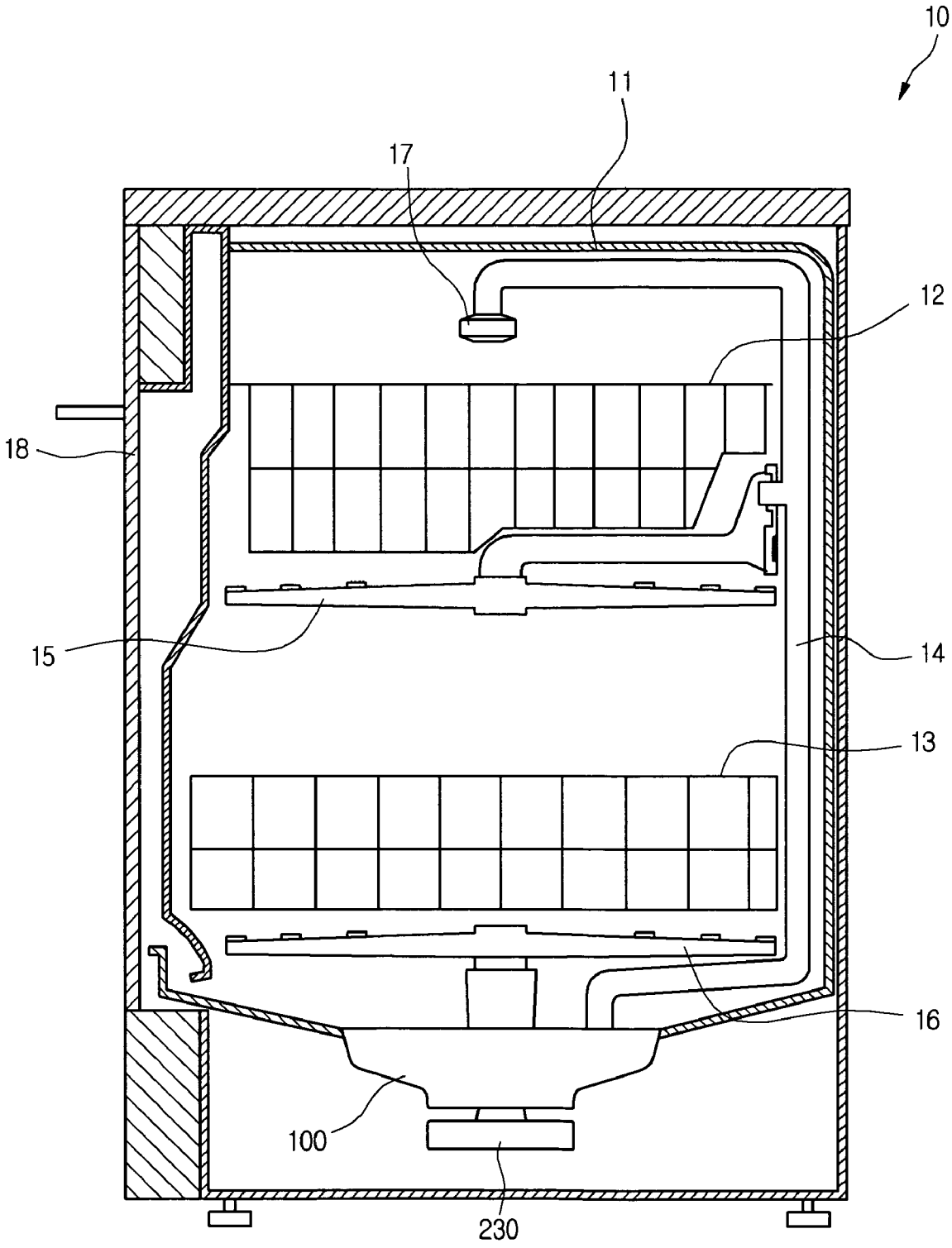
FIG. 1 is a sectional view of a dishwasher having a sump mounting structure according to an embodiment of the present invention.

FIG. 1 is a sectional view of a dishwasher having a sump mounting structure according to an embodiment of the present invention.

Referring to FIG. 1, a dishwasher 10 includes a tub defining a washing chamber, a door 18 provided in front of the tub 11 to open and close the washing chamber, and a sump assembly 100 mounted on a bottom-center of the tub 11 and reserving washing water therein.

The dishwasher 10 further includes a washing motor 230 mounted on a bottom of the sump assembly 100 and disposed in the sump assembly 100 to drive a washing pump (not shown), a water guide 14 defining a path along which washing water pumped out by the washing pump flows, a lower nozzle 16 coupled to a top of the sump assembly 100 to the washing water spray upward and/or downward in the washing chamber, an upper nozzle 15 extending from a portion of the water guide 14 toward a center of the tub 11, and a top nozzle 17 extending from a top of the water guide 14 and located near a ceiling of the tub 11 to spray the washing water downward.

The dishwasher 10 further includes an upper rack 12 placed right above the upper nozzle 15 and a lower rack 13 disposed right above the lower nozzle 16. That is, the dishes received on the upper rack 12 are washed by the washing water sprayed from the upper and top nozzles 15 and 17. The dishes received on the lower rack 13 are washed by the washing water sprayed from the lower nozzle 16.

The operation of the dishwasher 10 will be now described.

The door 18 is first opened and the upper rack 12 and/or lower rack 13 are withdrawn out of the dishwasher 10. The dishes are arranged on the racks 12 and 13. Then, the racks 12 and 13 are returned to their initial locations and the door 18 is closed. The operation button is pushed to wash the dishes received on the racks 12 and 13.

Meanwhile, when the operation button is pushed, a water supply valve is opened so that the washing water is supplied into the sump assembly 100. After a predetermined amount of the washing water is supplied into the sump assembly 100, the washing motor 230 operates. At this point, an impeller (refer to the reference number 2 of FIG. 2) connected to a motor shaft of the washing motor 230 and disposed in the washing pump rotates to pump the washing water to the lower nozzle 16 and the water guide 14.

The washing water pumped out to the water guide 14 is sprayed into the washing chamber via the top and upper nozzles 17 and 15. The washing water sprayed downward from the top nozzle 17 and the washing water sprayed upward from the upper nozzle 15 wash the dishes loaded on the upper rack 12.

The washing water sprayed upward from the lower nozzle 16 washes the dishes loaded on the lower rack 13. By forming spraying holes on a bottom of the upper nozzle 15, the upper nozzle 15 may spray the washing water upward and downward to simultaneously wash both surfaces of the dishes.

The foreign objects generated during the washing process are filtered by a filter (not shown) provided in the sump assembly 100 and ground to small particles by a disposer (not shown) mounted in the sump assembly 100. When the washing process is finished, the used washing water is drained together with the foreign objects out of the dishwasher 10 through a drain pump (not shown).

When the used washing water is drained, clean rinsing water is supplied to the sump assembly 100 through a washing water inlet and sprayed through the nozzles 15, 16 and 17 to perform a rinsing process. When the rinsing process is finished, a drying process is performed to complete the whole washing process.

Figure 2:
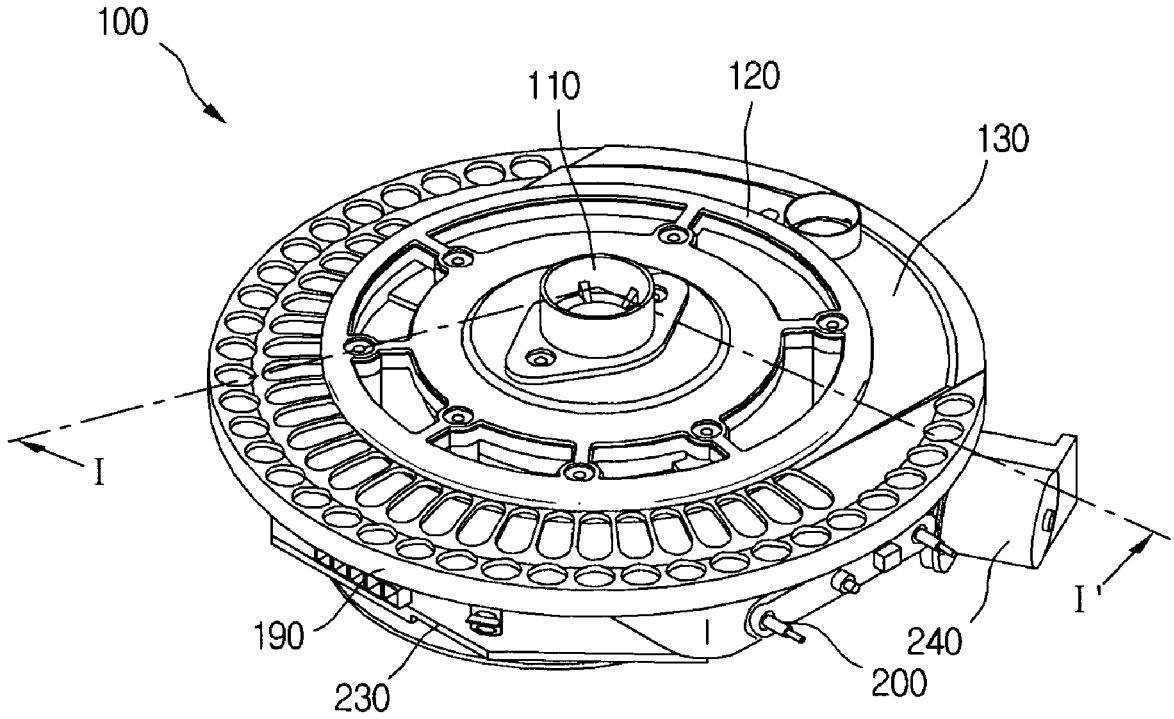
FIG. 2 is a perspective view of a sump assembly depicted in FIG. 1.
Figure 3:
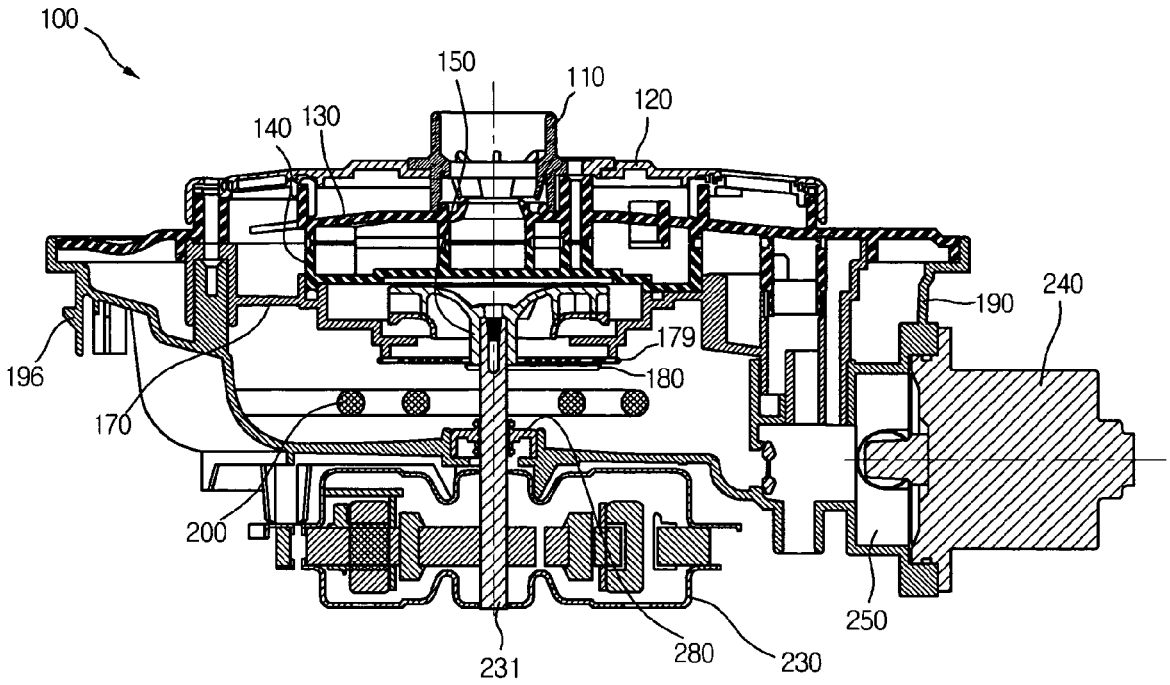
FIG. 3 is a vertical sectional view taken along lines I-I' of FIG. 2.
Figure 4:
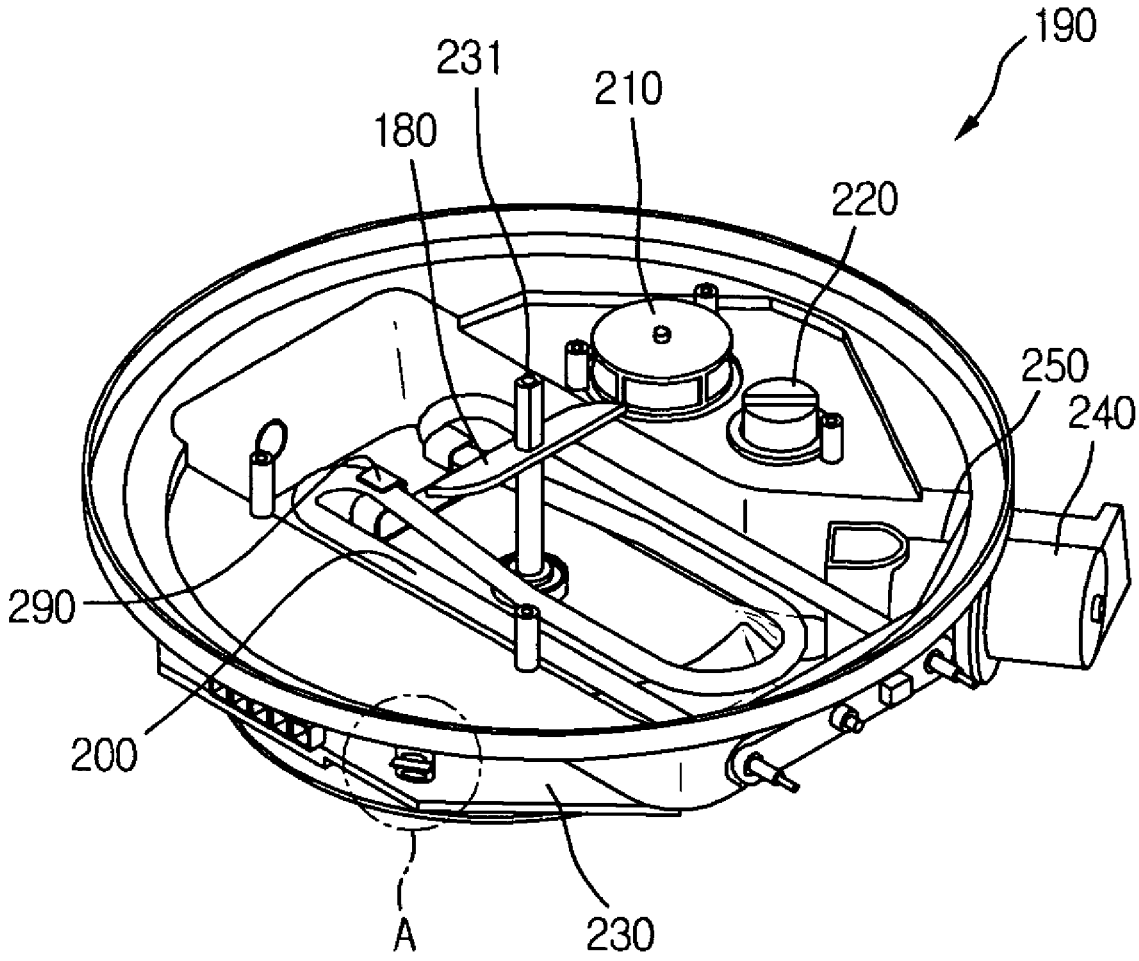
FIG. 4 is an exploded perspective view of a sump case depicted in FIG. 2.

FIG. 2 is a perspective view of a sump assembly depicted in FIG. 1, FIG. 3 is a vertical sectional view taken along lines I-I' of FIG. 2, and FIG. 4 is an exploded perspective view of the sump assembly depicted in FIG. 4.

Referring to FIGS. 2 through 4, the sump assembly 100 includes a sump case 190 for reserving the washing water, a sump cover 130 for covering an opening of the sump case 190, a self-cleaning filter assembly 120 disposed on a top portion of the sump cover 130 and elevated by a predetermined height, a lower nozzle holder 110 disposed on the central portion of the self-cleaning filter assembly 120 and connected to the lower nozzle 16, a washing motor 230 mounted on a lower portion of the sump case 190 to generate rotational force, and a drain pump 250 and a drain motor 240 that are mounted on a side portion of the sump case 190 to drain the washing water to an external side.

In addition, the sump assembly 100 further includes a heater 200 mounted on an inner bottom of the sump case 190 to heat the washing water, a disposer 180 rotating together with a motor shaft 231 to grind food wastes, a pump lower 170 forming a soil chamber in which the food wastes are accumulated, a fluid passage guide 140 disposed between the sump cover 130 and the pump lower 170, a washing pump 290 disposed between the pump lower 170 and the fluid passage guide 140 to pump out the washing water, and a screen filter 179 disposed between the pump lower 170 and the disposer 180 to prevent the food waste ground by the disposer 180 from being introduced into the washing pump 290.

The screen filter 179 is provided with a plurality of pores to filter the food wastes and attached on a bottom of the pump lower 170. The washing pump 290 includes a pump case 171 disposed on a central portion of the pump lower 170 and an impeller 150 disposed in the pump case 171. The impeller 150 rotates together with the motor shaft 231 to suck the washing water reserved in the sump case 190 and discharge the sucked washing water to an external side. The fluid passage guide 140 is provided at a top surface with a passage for guiding the washing water pumped by the washing pump 290 to the upper nozzle or the lower nozzle.

The sump assembly 100 includes a vario valve 210 mounted on a side portion of the sump case 190, a turbidity sensor 220 mounted near the vario valve 210, and a pump sealer 160 fitted in a groove formed on a top surface of the pump lower 170. That is, the vario valve 210 functions to alternately flow to the upper and lower nozzles. The turbidity sensor 220 detects a pollution level of the washing water collected in the sump assembly 100 during the washing process. The pump sealer 160 prevents leakage of the washing water through edges of the washing pump 290 and the vario valve 210.

The operation of the above-described sump assembly 100 will be now described.

When the washing process starts, the washing water is supplied from the water supply unit to the sump case 190. At this point, the impeller 150 rotates by the operation of the washing motor 230 to direct the washing water into the pump case 171. The washing water directed to the pump case 171 flows to the vario valve 210. The washing water flowing to the vario valve 210 further flows to the water guide 14 or the upper nozzle holder 110 along the passage formed on the top surface of the fluid passage guide 110.

Meanwhile, a part of the washing water flowing from the washing pump 290 to the vario valve 210 flows to the turbidity sensor 220 so that the pollution level of the washing water can be detected. The washing water 220 passing through the turbidity sensor 220 flows to the drain pump 250. The washing water collected in the drain pump 250 is drained out of the dishwasher by the drain motor 240.

Figure 5:
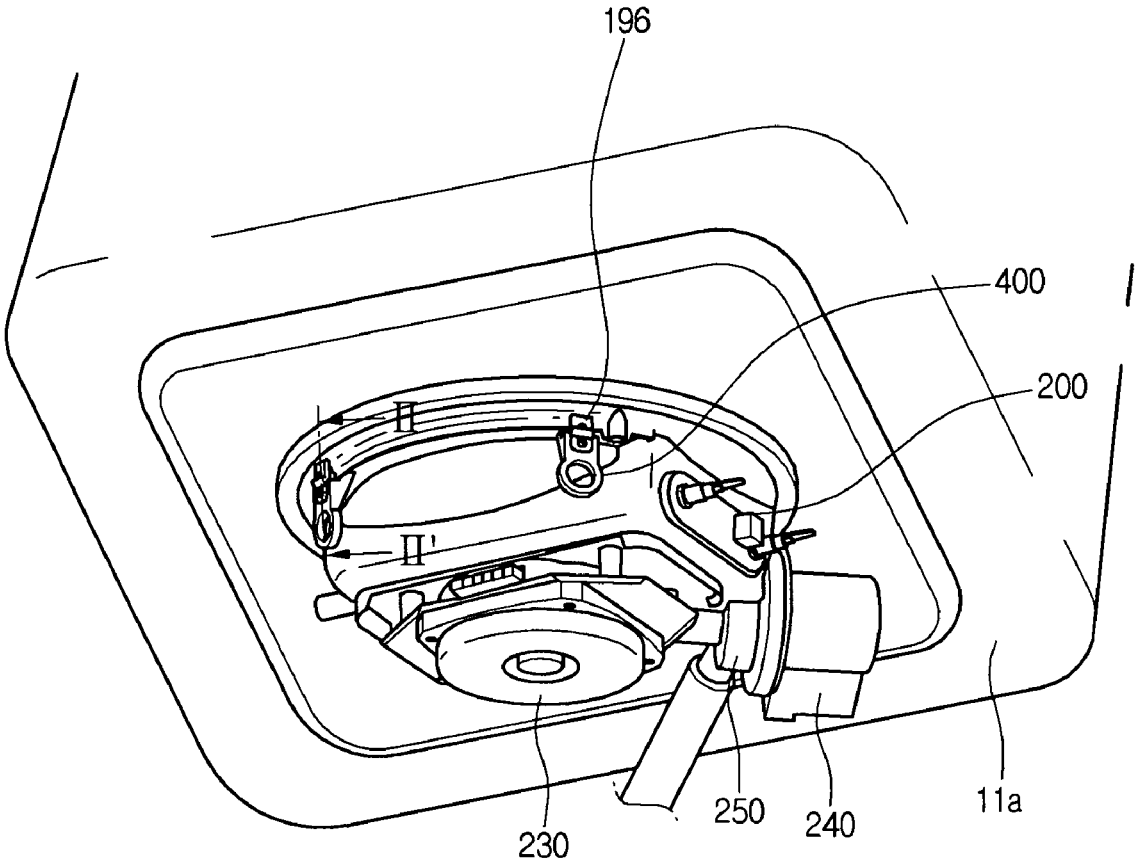
FIG. 5 is a bottom perspective view illustrating a sump mounting structure of the dishwasher according to an embodiment of the present invention.

FIG. 5 is a bottom perspective view illustrating a sump mounting structure of the dishwasher according to an embodiment of the present invention.

Referring to FIG. 5, the sump assembly 100 is mounted on a tub lower 11*a* defining a bottom of the tub 11.

A sump mounting structure includes a mounting hook unit 196 formed on an upper frame portion of he sump assembly 100 and a mounting ring unit 400 fitted in the mounting hook unit 196 to allow the mounting hook unit 196 to couple the tub lower 11*a* to the sump 100.

The sump assembly includes a washing motor 230 for driving the washing pump 290 mounted in the sump assembly 100, a drain pump 250 formed on a side portion of the sump assembly 100 to drain the washing water therethrough, and a drain motor 240 for driving the drain pump 250.

The sump mounting structure may be provided one or two locations along an outer circumference of the sump assembly. Preferably, the sump mounting structure may be provided two locations on a front side of the dishwasher.

Figure 6:
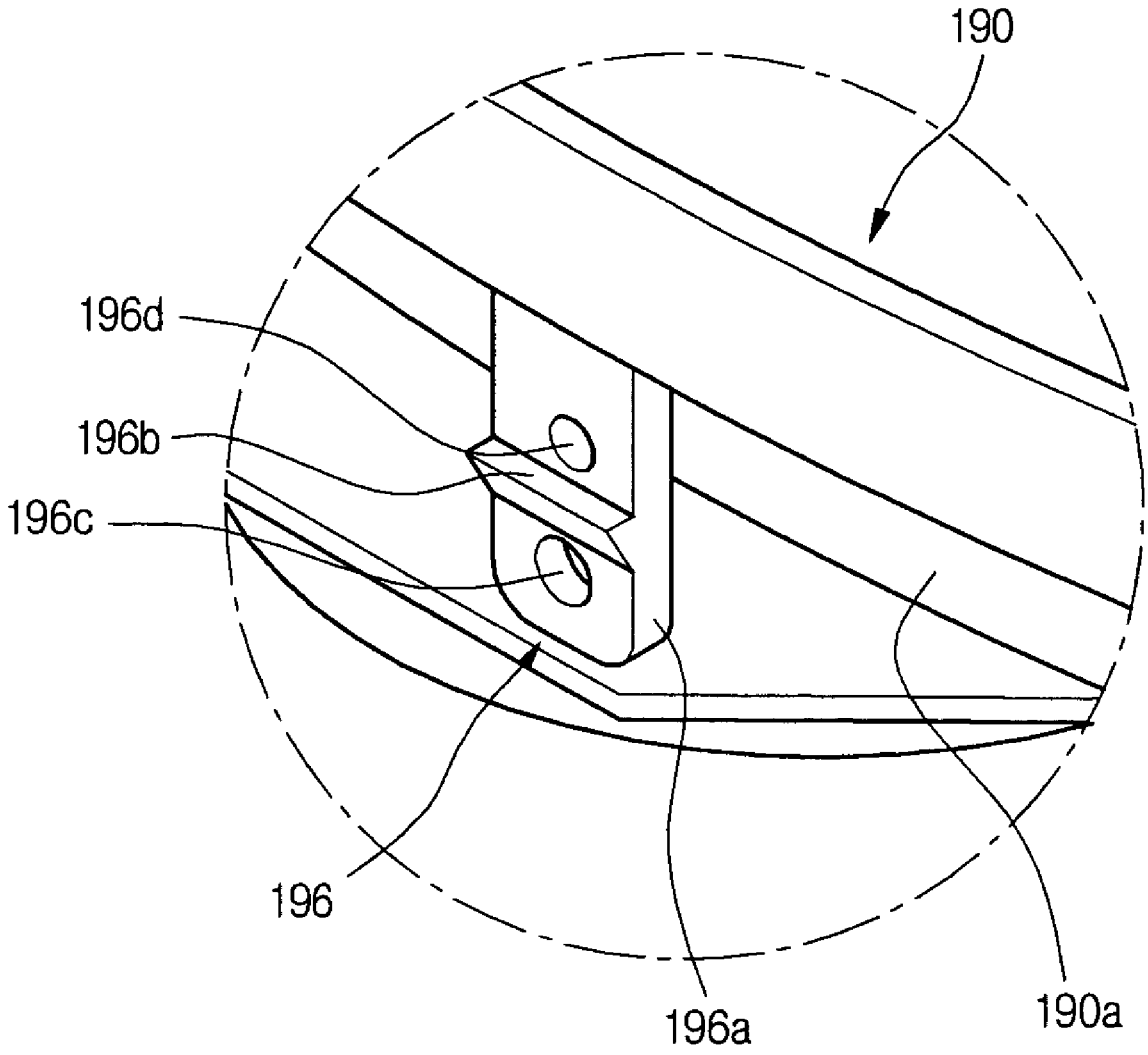
FIG. 6 is an enlarged view of a portion A of FIG. 4.

FIG. 6 is an enlarged view of a portion A of FIG. 4.

Referring to FIG. 6, the mounting hook unit 196 is formed on the outer circumference of the sump case 190.

That is, the mounting hook unit 196 includes a hook body 196*a*, a hook portion 196 that is inclined and protruded from an approximately center of the hook body 196*a*, a boss insertion hole 196*d* formed above the hook portion 196*b*, a coupling hole 196*c* formed below the hook portion 196*b*. A fixing boss (see 460 of FIG. 7) of the mounting ring unit 400 is inserted into the boss insertion hole 196*d*. This will be described later. A reinforcing rib 190*a* extends downward from the sump case 190. The reinforcing rib 190*a* is inserted into a reinforcing rib insertion hole (see 450 of FIG. 7) of the mounting ring unit 400.

Figure 7:
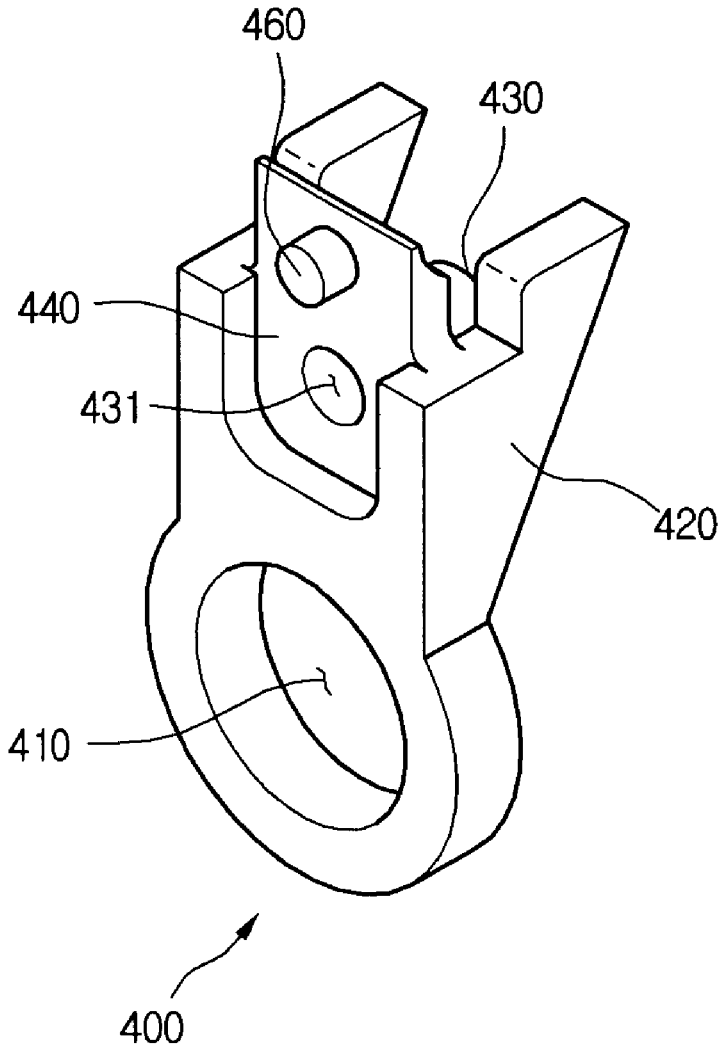
FIG. 7 is a perspective view of a mounting ring unit according to an embodiment of the present invention.

FIG. 7 is a perspective view of the mounting ring unit.

Referring to FIG. 7, the mounting ring unit 400 is fitted in the mounting hook unit 196 to allow the sump 100 to be securely coupled to the tub lower 11*a*.

That is, the mounting ring unit 400 includes a finger ring 410 in which a human finger can be inserted, a mounting hook seating surface depressed and formed above thee finger ring 410, and a fixing boss 460 protruded from the mounting hook seating surface 440.

The mounting ring 400 further includes a sump supporting portion 420 extending rearward from the finger ring 410, a reinforcing rib insertion hole 450 formed with a predetermined depth between the mounting hook seating surface 440 and the sump supporting portion 420, and a coupling boss 430 extending rearward from the mounting hook seating surface 440.

The hook body 196*a* of the mounting hook unit 196 seats on the mounting hook seating surface 440 and the coupling hole 431 in which a coupling member is inserted is formed inside the coupling boss 430. The coupling boss 430 is formed above or below the fixing boss 460. The fixing boss 460 is inserted in the boss insertion hole 196*a* of the mounting hook unit 196. The reinforcing rib 190*a* is inserted in the reinforcing rib insertion hole 450.

After the mounting ring unit 400 is fitted in the mounting hook unit 196, the coupling member inserted in the coupling hole 431 is first removed to dismount the sump assembly 100. Then, after inserting a finger in the finger ring 410, the user pulls the mounting ring unit 400. Here, when pulling the mounting ring unit 400, the user applies force downward to remove the mounting ring unit 400 from the mounting hook unit 196.

Figure 8:
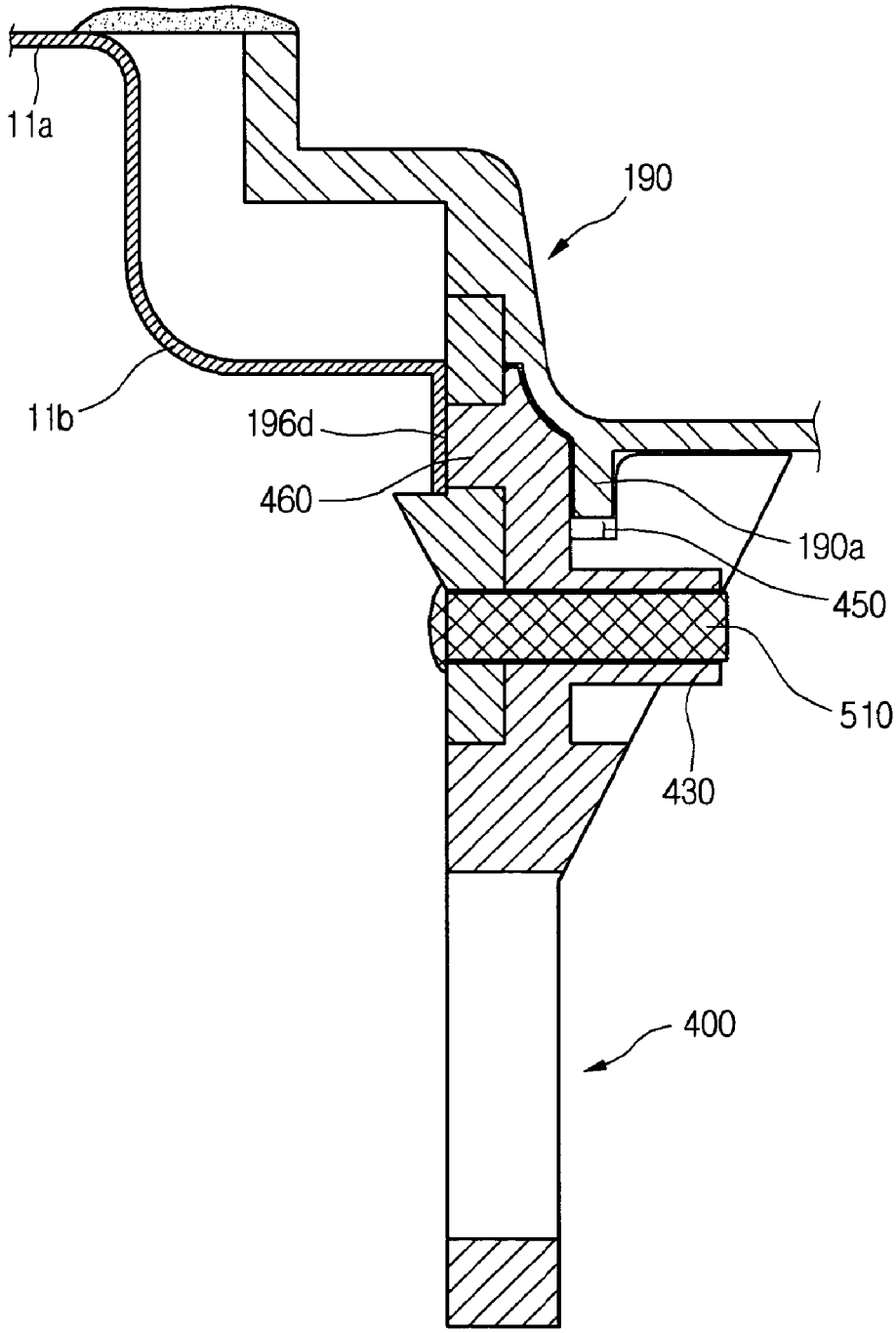
FIG. 8 is a sectional view taken along line II-II' of FIG. 5.

FIG. 8 is a sectional view taken along line II-II' of FIG. 5.

Referring to FIG. 8, the tub lower 11*a* is provided with a hole for receiving the sump assembly 100. An edge defining the hole is curved downward to form a sump coupling sleeve 11*b*. A part of an upper portion of the sump case 190 is inserted in the sump coupling sleeve 11*b*. An end of the sump coupling sleeve 11*b* extends downward by a predetermined length. Therefore, when the sump assembly 100 is mounted, the end of the sump coupling sleeve 11*b* closely contacts the top surface of the hook portion 196*b*. The mounting hook unit 196 seats on the mounting hook seating surface of the mounting ring unit 400. The fixing boss 460 of the mounting ring unit 400 is inserted in the boss insertion hole 196*d* of the mounting hook 196. The coupling member 510 is inserted in the coupling boss 430 after passing through the coupling hole 431. The reinforcing rib 190*a* is inserted in the reinforcing rib insertion hole 450. An upper end of the sump supporting portion 420 supports the bottom of the sump case 190.

Since the mounting ring unit 400 is inserted through a rear surface of the mounting hook unit 196, the mounting hook unit 196 is not pushed rearward. In addition, an end of the sump coupling sleeve 11*b* is not removed from the upper end of the hook portion 196*a*. Therefore, the sump assembly 100 is not dismounted from the tub lower 11*a*. That is, when the mounting hook unit 196 is pushed rearward, the end portion of the sump coupling sleeve 11*b* is removed from the hook portion 196*b*, as a result of which the sump assembly 100 is lifted into the tub 11. However, in the present invention, since the mounting ring unit 400 is mounted on the rear surface of the mounting hook unit 916, the sump assembly 11 is not lifted upward. Therefore, the dismounting of the sump assembly 100 from the bottom of the tub 11 can be prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A sump mounting structure of a dishwasher having a tub comprising:

a sump assembly mounted at a bottom of the tub to receive washing water;

at least one mounting hook unit formed at an upper portion of the sump assembly to fix the sump assembly to the tub and extending from an outer circumference of the sump assembly and contacting a bottom portion of the tub; and a mounting ring unit detachably coupled to the mounting hook unit to prevent the mounting hook unit from becoming unfixed from the tub.

2. The sump mounting structure according to claim 1, wherein the sump assembly includes a sump case for reserving washing water and a sump cover seated on an upper portion of the sump case and the mounting hook unit is formed on an outer frame portion of the sump case.

3. The sump mounting structure according to claim 1, wherein the mounting hook unit extends downward from an outer frame of the sump assembly by a predetermined length.

4. The sump mounting structure according to claim 1, wherein the mounting hook unit includes a hook body extending from an outer frame portion of the sump assembly, a hook portion protruded from a front surface of the hook body, a boss insertion hole formed above and/or below the hook portion, and a coupling member insertion hole formed on above and/or below the boss insertion hole.

5. The sump mounting structure according to claim 1, wherein the mounting ring unit includes a seating surface on which the mounting hook unit seats, a fixing boss protruded from the seating surface and penetrating the mounting hook unit, a finger ring formed below the seating surface, a coupling boss extending from the seating surface for coupling with the mounting hook unit, and a sump supporting portion bent rearward from the seating surface to support a bottom of the sump assembly.

6. The sump mounting structure according to claim 1, wherein the mounting hook unit is formed at one or more observable locations on a front surface of the tub.

7. The sump mounting structure according to claim 1, wherein the sump assembly includes a reinforcing rib formed at a location spaced inward from a location where the mounting hook unit is formed and the reinforcing rib is inserted in a groove formed on an upper portion of the mounting ring unit.

8. A sump mounting structure of a dishwasher having a tub comprising:

a sump case mounted on a bottom of the tub to receive washing water;

a sump cover covering the sump case;

at least one mounting hook unit formed at an upper portion of the sump case to fix the sump assembly to the tub, and extending from an outer circumference of the sump case, the mounting hook unit having a hook portion protruded from a front surface thereof; and a mounting ring unit removably fitted on the mounting hook unit to prevent the mounting hook unit from becoming unfixed from the tub.

9. The sump mounting structure according to claim 8, wherein the tub has a hole whose edge is curved downward and whose end portion closely contacts the hook portion.

10. The sump mounting structure according to claim 8, wherein the mounting ring unit includes a fixing boss extending from a front surface thereof and the mounting hook unit has a boss hole in which the fixing boss is inserted, the boss hole being formed above the hook portion and having a predetermined diameter.

11. The sump mounting structure according to claim 8, wherein the mounting hook has a coupling boss extending rearward and having a predetermined length and a predetermined diameter, the mounting hook unit has a coupling hole formed below the hook portion and having a predetermined diameter, and a coupling member is coupled to the coupling boss after penetrating the coupling hole.

12. The sump mounting structure according to claim 8, further comprising a circular reinforcing rib extending from a bottom of the sump case.

13. The sump mounting structure according to claim 12, wherein the mounting ring unit has an insertion groove in which the reinforcing rib is inserted.

14. The sump mounting structure according to claim 8, wherein the mounting ring unit has a close-contacting portion depressed by a predetermined depth from a front surface of the mounting ring unit, the mounting hook unit close-contacting the close-contacting portion.

15. The sump mounting structure according to claim 8, wherein the mounting ring unit includes a sump supporting portion whose top surface supports a bottom of the sump case.

16. The sump mounting structure according to claim 8, wherein the mounting ring unit has a handle formed on a lower portion thereof.

17. The sump mounting structure according to claim 8, wherein the mounting hook unit is formed at two locations on a front surface of the sump case.

18. The sump mounting structure according to claim 8, wherein the mounting ring unit is fitted from a lower portion of the mounting hook unit to an upper portion of the mounting hook unit.

19. A dishwasher comprising:

a tub;

a sump coupling sleeve formed at a lower portion of the tub;

a washing water reserving unit mounted on a bottom of the tub, the washing water reserving unit having a sump case for receiving washing water and a sump cover for covering the sump case, a part of an upper portion of the sump case being inserted in the sump coupling sleeve;

a mounting hook unit formed on an upper portion of the sump case and extending from an outer circumference of the sump case, wherein at least one portion of the mounting hook unit contacts a lower portion of the sump coupling sleeve for fixing the sump case to the tub; and a mounting ring unit detachably fitted to the mounting hook unit to prevent the mounting hook unit from becoming unfixed from the tub.

20. The dishwasher according to claim 19, wherein the mounting ring unit is fixed on a rear surface of the mounting hook unit by a coupling member coupled to a boss formed on a front surface of the mounting ring unit.

* * * * *